US010746417B1

(12) United States Patent
Gorman

(10) Patent No.: US 10,746,417 B1
(45) Date of Patent: Aug. 18, 2020

(54) PACKAGED TERMINAL AIR CONDITIONER SYSTEM AND SLEEVE THEREFOR

(71) Applicant: BANKMAN TRUST LLC, Fort Lauderdale, FL (US)

(72) Inventor: Christopher Allen Gorman, Fort Lauderdale, FL (US)

(73) Assignee: Bankman Trust LLC, Fort Lauderdale, FL (US)

( * ) Notice: Subject to any disclaimer, the term of this patent is extended or adjusted under 35 U.S.C. 154(b) by 0 days.

(21) Appl. No.: 16/665,205

(22) Filed: Oct. 28, 2019

Related U.S. Application Data

(60) Provisional application No. 62/866,788, filed on Jun. 26, 2019.

(51) Int. Cl.
*F24F 1/03* (2019.01)
*F24F 13/22* (2006.01)
*F24F 1/0355* (2019.01)

(52) U.S. Cl.
CPC ..... *F24F 1/03* (2019.02); *F24F 1/0355* (2019.02); *F24F 13/222* (2013.01)

(58) Field of Classification Search
CPC ..... F24F 1/03; F24F 1/02; F24F 1/00; F24F 1/027; F24F 1/022; F24F 1/36; F24F 1/0059; F24F 1/0007; F24F 1/0355; F24F 13/222
See application file for complete search history.

(56) References Cited

U.S. PATENT DOCUMENTS 3,022,647 A * 2/1962 Mullin ..... F24F 1/02 62/427
7,140,749 B2 * 11/2006 Culbert ..... A61L 9/20 422/186.3
2012/0324928 A1 * 12/2012 Durham ..... G05B 13/0205 62/129

* cited by examiner

*Primary Examiner* — Emmanuel E Duke
(74) *Attorney, Agent, or Firm* — The Concept Law Group, PA; Scott D. Smiley; Scott M. Garrett

(57) ABSTRACT

A packaged terminal air conditioner (PTAC) system includes a wall sleeve in which a chassis is mounted. The chassis includes the major electrical and mechanical components for the evaporator and condenser sections, and includes a pan that collects condensate from the evaporator section for use in cooling the condenser coil. The sleeve includes one or more guide openings in a sidewall, and correspondingly mounted guide structures inside the sleeve that are configured to guide treatment pellets into different portions of the PTAC system to suppress or inhibit microbial growth. This arrangement obviates the need to partially disassemble the PTAC unit to remove the chassis so that treatment pellets can be placed into the PTAC unit.

20 Claims, 14 Drawing Sheets

PACKAGED TERMINAL AIR CONDITIONER SYSTEM AND SLEEVE THEREFOR

CROSS REFERENCE

This application claims the benefit of U.S. Provisional Application No. 62/866,788, filed Jun. 26, 2019, the entirety of which is hereby incorporated by reference.

FIELD OF THE DISCLOSURE

The present disclosure relates generally to air conditioning systems, and more particularly to drainage maintenance of packaged terminal air conditioning (PTAC) units.

BACKGROUND OF THE DISCLOSURE

Air conditioning systems are in widespread use and are provided in two general arrangements. There are "split" systems where the evaporator unit is located indoors, and the compressor unit is located outside, with refrigerant lines connecting the two units through a wall of the structure. There are also self-contained units that package the evaporator and compressor together in one unit. Some self-contained air conditioning (A/C) systems are designed to be mounted in a window, and other similar A/C units are designed to be mounted in a through-wall opening. A common self-contained A/C unit configuration is the packaged terminal air conditioner (PTAC), which are commonly used in hotel rooms, and similar multi-occupancy structures. As with all A/C systems, the evaporator unit chills air that is drawn or blown over the evaporator coil by a fan, resulting in moisture vapor in the warm air condensing and accumulating on the coil, where it collects and runs into a pan, and drains through a drain hole into a drainage line. In some arrangements, the water is simply routed to an outside port of the PTAC unit, allowing it to drip out. In some applications the cold water is used to cool the condenser coil by routing collected condensate to the condenser portion of the unit, and a fan can splash the water onto the condenser coil.

The high moisture environment inside of a PTAC unit is highly conducive to the growth of certain molds, algae, and other microbial growth. Over time, this growth can obstruct the drain, causing a blockage, resulting in an overflow of water into the interior of the structure, resulting in water damage and potentially giving rise to other forms of mold growth in the building structure. Accordingly, property owners want to avoid the cost of repairs due to water damage caused by overflowing A/C units. This is especially problematic in self-contained A/C units because the drain pan is typically designed to hold some water to cool the coil of the compressor unit.

The problem of microbial growth in PTAC units is treated as a maintenance issue, and to prevent drain blockage from occurring, chemicals are periodically introduced into the drain pan to kill or suppress microbial growth. Chemical treatment is typically accomplished by the use of slow dissolving tablets that are placed in the drain pan. These tablets slowly dissolve in the condensate water, which creates a solution that flows into the drain, killing and inhibiting growth. However, to put these tablets into the drain pan, the PTAC unit must be taken apart by removing the chassis from the wall sleeve in order to access the interior and place the tablets in the drain pan. Although the tablets only need to be added once every several weeks or so, because of the difficulty and inconvenience involved, PTAC units often go untreated for too long, or not at all. It isn't until leakage is noticed that the drain blockage is recognized.

Therefore, a need exists to overcome the problems with the prior art as discussed above.

SUMMARY OF THE DISCLOSURE

In accordance with some embodiments, the inventive disclosure provides a wall sleeve for a packaged terminal air conditioner (PTAC) that is configured to receive a chassis in which a compressor unit and a evaporator unit are provided, the chassis including a chassis drain pan. The wall sleeve includes a front having an opening through which the chassis can be placed to mount the chassis in the wall sleeve, a side wall having an exterior side and an interior side, a first aperture formed through the side wall, and a first guide structure disposed on an inside of the side wall at the interior surface and having a receiving portion positioned in correspondence with the first aperture and a lower portion arranged in a position over the chassis drain pan when the chassis is mounted in the wall sleeve.

In accordance with another feature, the first guide structure is a tube having a lower portion positioned at an angle with respect to the side wall of between zero and forty five degrees.

In accordance with another feature, the tube is a copper tube having a diameter of between one quarter inch and three quarters of an inch.

In accordance with another feature, the first guide structure comprises a ramp that is configured to direct a treatment tablet placed through the first aperture into the chassis drain pan.

In accordance with another feature, there is further provided a cover disposed on the outside surface of the side wall of the wall sleeve, over the first aperture, wherein the cover is configured to be moveable to allow a user to place a treatment pellet into the first guide structure through the first aperture.

In accordance with another feature, the wall sleeve includes a wall sleeve drain pan at a bottom of the wall sleeve, and there is further provided a second aperture formed in the side wall of the wall sleeve, and a second guide structure disposed on an inside of the side wall at the interior surface and having a receiving portion positioned in correspondence with the first aperture and a lower portion arranged in a position over the wall sleeve drain pan when the chassis is mounted in the wall sleeve.

In accordance with another feature, there is further provided a third aperture formed in the side wall of the wall sleeve, and a guide tube having a first end disposed in correspondence with the third aperture, a first downward portion configured to pass between the interior surface of the side wall and the chassis drain pan when the chassis is mounted in the wall sleeve, a horizontal portion extending from a bottom of the first downward portion to a second downward portion configured over a drain hole in the wall sleeve drain pan, and wherein the horizontal portion is disposed along the wall sleeve drain pan to be between the chassis drain pan and the wall sleeve drain pan when the chassis is mounted in the wall sleeve, and the second downward portion continues from the horizontal portion and turn downward into the drain hole of the wall sleeve drain pan.

In accordance with some embodiments, the inventive disclosure provides a packaged terminal air conditioner (PTAC) that includes a wall sleeve at least one opening formed through the wall sleeve at a side of the wall sleeve, the wall sleeve defining an internal space, and having an open front. The PTAC further includes a chassis having a chassis drain pan, the chassis disposed in the internal space of the wall sleeve, the chassis drain pan configured to collect condensate from an evaporator coil that is mounted in the chassis. The PTAC further includes a guide structure disposed in the internal space and connected, at an upper end of the guide structure, to in internal surface of a sidewall of the wall sleeve in correspondence with an opening through the sidewall of the wall sleeve, and having a lower end positioned over the chassis drain pan.

In accordance with a further feature, there is further provided a second guide structure having an upper end mounted to the sidewall of the wall sleeve in correspondence with a second opening through the sidewall of the wall sleeve, and having a lower end positioned over a wall sleeve drain pan formed in a bottom of the wall sleeve.

In accordance with another feature, the lower end of the guide structure is configured at an angle of between zero of forty five degrees.

In accordance with another feature, the guide structure comprises a tube.

In accordance with another feature, the guide structure comprises a ramp having a bottom, and walls on opposing sides of the bottom.

In accordance with another feature, there is further provided a cover disposed on an outside surface of the wall sleeve, over the opening, wherein the cover is configured to be moveable to allow a user to place a treatment pellet into the guide structure through the opening.

In accordance with another feature, there is further provided a third guide structure having an upper end mounted at the inside of the wall sleeve in correspondence with a third opening, the third guide structure having a body portion that runs under the chassis drain pan to a drain hole in the bottom of the wall sleeve.

In accordance with some embodiments, the inventive disclosure provides a wall sleeve for a packaged terminal air conditioner (PTAC) system including a sidewall having a first opening and a second opening formed through the sidewall, wherein each of the first and second openings are formed at a location that is selected to be exposed when the wall sleeve is mounted in a wall. The wall sleeve further includes a bottom, wherein the bottom forms a wall sleeve drain pan and comprises a drain hole. The wall sleeve further includes a front opening configured to receive a chassis therethrough, the chassis having a chassis drain pan. The wall sleeve further includes a first guide structure having an upper portion mounted in correspondence with the first opening in the sidewall of the wall sleeve at an inside of the sidewall, the first guide structure having a lower end that is configured to be over the chassis drain pan when the chassis is mounted in the wall sleeve such that a treatment pellet placed through the first opening will be guided by the first guide structure from the first opening into the chassis drain pan. The wall sleeve further includes a second guide structure having an upper portion mounted in correspondence with the second opening in the sidewall of the wall sleeve at the inside of the sidewall, the second guide structure having a lower end that is configured to be over the wall sleeve drain pan when the chassis is mounted in the wall sleeve such that a treatment pellet placed through the second opening will be guided by the second guide structure from the second opening into the wall sleeve drain pan.

In accordance with a further feature, the sidewall includes a third opening in the sidewall, the wall sleeve further comprises a third guide structure having an upper portion at a first end that is mounted in correspondence with the third opening in the sidewall of the wall sleeve at the inside of the sidewall, the third guide structure having a lower end that is configured to sit between the chassis drain pan and the wall sleeve drain pan, and which has a second end positioned over the drain hole and which is turned downward toward the drain hole.

In accordance with another feature, the bottom of the wall sleeve is sloped around the drain hole to direct water into the drain hole.

In accordance with another feature, the first and second guide structures are made of tubing.

In accordance with another feature, there is further provided a cover disposed on an outside of the sidewall over the first and second openings.

In accordance with another feature, the lower end of the second guide structure is configured to pass, in part, between an exterior side of the chassis drain pan and an interior side of the sidewall.

In accordance with another feature, the bottom of the wall sleeve comprises at least two raised features configured to support the chassis and maintain a separation between the chassis and the bottom of the wall sleeve outside of the at least two raised features.

In accordance with some embodiments of the inventive disclosure, there is provided a wall sleeve assembly for a packaged terminal air conditioner (PTAC) that includes a wall sleeve having a side, a bottom, and open front configured to receive a PTAC chassis. The side of the wall sleeve having a plurality of openings arranged on a circular path. The wall sleeve assembly further includes a rotating cover mounted over the plurality of openings. The rotating cover is mounted on the side of the wall sleeve on an outside of the wall sleeve so as to rotate about a center of the circular path. The rotating cover further has exactly one opening positioned on the rotating cover to follow the circular path. The wall sleeve assembly further includes a mounting plate mounted at an inside of the side of the wall sleeve having a plurality of openings that correspond to the plurality of opening arranged on the circular path through the side of the wall sleeve. The wall sleeve assembly further includes a plurality of guide structures, each one of the plurality of guide structures being mounted in a respective one of the plurality of openings in the mounting plate, and wherein each one of the plurality of guide structures comprises a feature at an end of the guide structure that is captured between the mounting plate and the side of the wall sleeve.

In accordance with a further feature, the plurality of guide structures includes a drain access tube, a guide structure configured to guide a treatment pellet into a chassis pan of the chassis, and a guide structure configured to guide a treatment pellet into the bottom of the wall sleeve.

In accordance with a further feature, the openings in the mounting plate are shouldered holes, each one of the plurality of guide structures comprise a flange portion that fits within a shoulder recess of the shouldered opening and is captured between the shoulder recess and the side of the wall sleeve.

In accordance with a further feature, the mounting plate has a corner that is configured to fit into a corner of the wall sleeve at an inside of the wall sleeve to align the plurality of openings in the mounting plate with the plurality of opening in the side of the wall sleeve.

In accordance with a further feature, the bottom of the wall sleeve comprises a drain hole, and wherein the bottom of the wall sleeve is sloped downward to the drain hole.

Although the disclosure is illustrated and described herein as embodied in a wall sleeve for a packaged terminal air conditioner unit and a packaged terminal air conditioner unit using the wall sleeve, it is, nevertheless, not intended to be limited to the details shown because various modifications and structural changes may be made therein without departing from the spirit of the disclosure and within the scope and range of equivalents of the claims. Additionally, well-known elements of exemplary embodiments of the disclosure will not be described in detail or will be omitted so as not to obscure the relevant details of the disclosure.

Other features that are considered as characteristic for the disclosure are set forth in the appended claims. As required, detailed embodiments of the present disclosure are disclosed herein; however, it is to be understood that the disclosed embodiments are merely exemplary of the disclosure, which can be embodied in various forms. Therefore, specific structural and functional details disclosed herein are not to be interpreted as limiting, but merely as a basis for the claims and as a representative basis for teaching one of ordinary skill in the art to variously employ the present disclosure in virtually any appropriately detailed structure. Further, the terms and phrases used herein are not intended to be limiting; but rather, to provide an understandable description of the disclosure. While the specification concludes with claims defining the features of the disclosure that are regarded as novel, it is believed that the disclosure will be better understood from a consideration of the following description in conjunction with the drawing figures, in which like reference numerals are carried forward. The figures of the drawings are not drawn to scale.

Before the present disclosure is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present disclosure, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present disclosure and simplify the description, but not to indicate or imply that the devices or components must have a specific azimuth, or be constructed or operated in the specific azimuth, which thus cannot be understood as a limitation to the embodiments of the present disclosure. Furthermore, terms such as "first", "second", "third" and so on are only used for descriptive purposes, and cannot be construed as indicating or implying relative importance.

In the description of the embodiments of the present disclosure, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. Those skilled in the art can understand the specific meanings of the above-mentioned terms in the embodiments of the present disclosure according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present disclosure.

DETAILED DESCRIPTION

Figure 1:
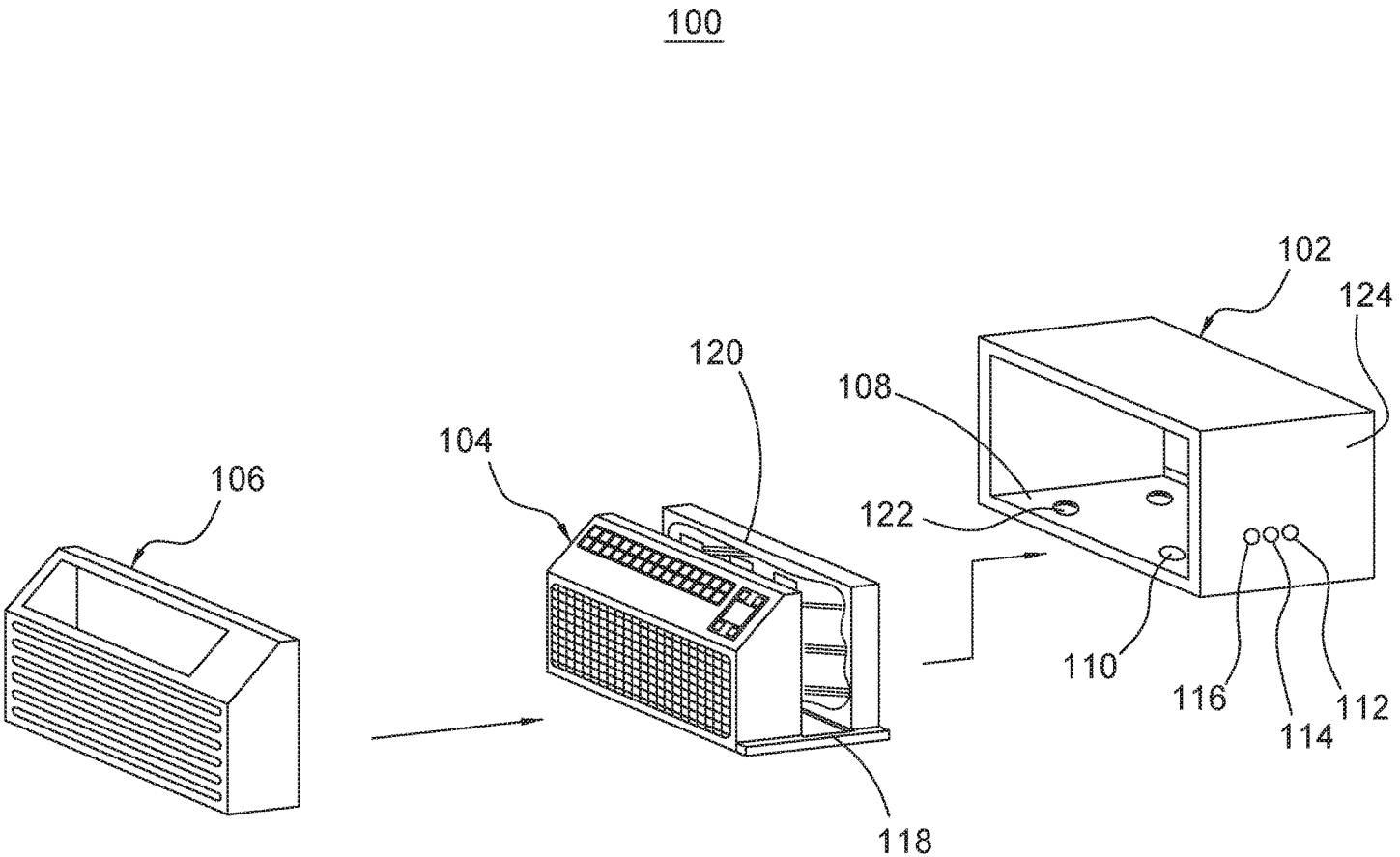
FIG. 1 is an exploded isometric view of a package terminal air conditioner (PTAC) system 100 include a wall sleeve designed in accordance with some embodiments.

While the specification concludes with claims defining the features of the disclosure that are regarded as novel, it is believed that the disclosure will be better understood from a consideration of the following description in conjunction with the drawing figures, in which like reference numerals are carried forward. It is to be understood that the disclosed embodiments are merely exemplary of the disclosure, which can be embodied in various forms.

The present disclosure provides a novel and efficient self-contained air conditioner unit that allows drainage maintenance to be performed without having to take the air conditioner unit apart or disassemble any portion of the air conditioner unit. Embodiments of the disclosure provide a self-contained air conditioner unit suitable for a through-wall or in window application where the air conditioner unit provides access-ways that allow a person to place anti-microbial treatment pellets into the internal drain pan(s) of the unit, as well providing directed access to the drain line in units that are more permanently installed.

FIG. 1 is an exploded isometric view of a package terminal air conditioner (PTAC) system 100 including a wall sleeve designed in accordance with some embodiments. A PTAC is a self-contained air conditioner system that includes the compressor unit and evaporator unit together in a chassis 104 that is mounted in a wall sleeve 102. The wall sleeve 102 is mounted in a wall, allowing access to the outside air. A PTAC is therefore different than a "split" system where the evaporator unit is located inside a building with an air handler, and where the compressor unit is located outside the building, and tubing is arranged between the two sections to carry refrigerant between them. PTAC systems are commonly used in hotel rooms, dormitories, and similar housing unit structures, and typically a PTAC system is installed through a wall, near the floor. A wall sleeve 102 is mounted in a similarly sized opening through the wall, and the small gap between the wall sleeve 102 and the wall can be weather sealed. The wall sleeve 102 can be formed of sheet metal, fiberglass, plastic, or any other suitable material, and is typically deeper, from front to back, than the wall (in which it is mounted) is thick. The wall sleeve 102 is designed to receive the chassis 104 into the wall sleeve 102 such that the chassis 104 is mounted in the wall sleeve 102. The chassis 104 includes all of the mechanical and electrical components of the air conditioner system, including the evaporator and compressor sections, as well as control circuitry to adjust the thermostat control, fan speed, and so on.

The chassis 104 has a front portion that sits inside the room and is covered by a housing 106, while the section including the condenser coil 120 is located in the back of the chassis 104 so that air from outside can be blown over the condenser coil 120 to remove heat from the compressed refrigerant in the condenser coil 120. Typically the back of the chassis 104 is covered with a louvre panel (not shown), as is known. When the PTAC is operating in a cooling mode, moisture that is in the air inside the room will condense on the evaporator coil. As the condensate collects it is routed to a drain to prevent water leaking out of the unit. It is common to use a chassis drain pan 118 to collect some of the condensate, and use the collected cold water to help cool the condenser coil 120. For example, the chassis drain pan 118 is typically arranged to collect water to a selected depth that allows the blades of the fan blowing air over the condenser coil 120 to splash water into the condenser coil 120. However, because the water then has to rise to selected drain level, some of the water stagnates in the chassis drain pan 118, allowing microbial growth to occur, which can clog the drainage path.

Typically the chassis drain pan 118 drains into a wall sleeve drain pan 108, which is essentially the bottom of the wall sleeve 102. A drain hole 110 can be formed through the bottom of the wall sleeve drain pan 108, and it is either connected to a drainage, or configured to drain out the rear of the unit (e.g. outside). Further, the wall sleeve drain pan 108 can have raised features 122 stamped or formed therein on which the bottom of the chassis 104 sits, providing space between the bottom of the chassis 104 and the wall sleeve drain pan 108.

In a conventional PTAC unit, the cover 106 and chassis 104 must be removed, at least partially, from the wall sleeve 102 in order to add treatment pellets to inhibit microbial growth in the drain pans 108, 118. Treatment pellets are formed of a chemical compound that dissolves slowly in water, and which then dissipates throughout the collected water, and into the drain, and can be formed in a variety of shapes and sizes, including, for example, spheres, belted spheres, disks, cylinders, and so on. Treatment pellets need to be added periodically since they dissolve and the flow of water dilutes the. Accordingly, it is common to establish a schedule for adding treatment pellets to the PTAC units in a facility like a hotel. However, the personnel tasked with doing so often find it difficult to take the PTAC units apart, as the chassis can be quite heavy, and care has to be taken to not spill water that may be sitting in the chassis drain pan 118. As a result, personnel sometimes neglect to perform the process of depositing treatment pellets into the PTAC units, or some PTAC units.

In order to simplify the task of putting treatment pellets into a PTAC unit, one or more openings such as apertures or openings 112, 114, 116 can be formed through a sidewall 124 of the wall sleeve 102 at a location that, when the wall sleeve 102 is installed in a wall, is exposed inside the room (e.g. a portion of the wall sleeve 102 that extends forward from the wall). However, the opening or openings are positioned such that they are not obscured by components in the chassis 104 or part of the chassis 104. On the inside of the wall sleeve 104, as will be shown in subsequent drawings, in correspondence with each opening 112, 114, 116 is a guide structure. Some of the guide structures are configured to guide a treatment pellet that is inserted into the corresponding opening to a desired location inside the PTAC unit 100. For example, aperture 112 can correspond to a guide structure that is configured to guide a treatment pellet into the chassis drain pan 118. Likewise, aperture 116 can correspond to the guide structure that is configured to guide a treatment pellet between the chassis drain pan 118 and the inside of the side wall 124 into the wall sleeve drain pan 108. A third aperture 114 can correspond to a guide structure that is configured to guide a drain snake to the drain 110 of the wall sleeve drain pan to allow servicing of the drain with the drain snake. Thus, once the PTAC unit 100 is assembled, with the chassis 104 mounted in the wall sleeve 102, maintenance personnel will no longer have to pull the chassis 104 out of the wall sleeve 102 in order to place treatment pellets into the unit. In some embodiments a cover structure can be provide on the outside of the side wall 124 that is moveable, and which covers the opening(s) 112, 114, 116 so as to prevent any undesired object or debris from getting into the unit 100.

Figure 2:
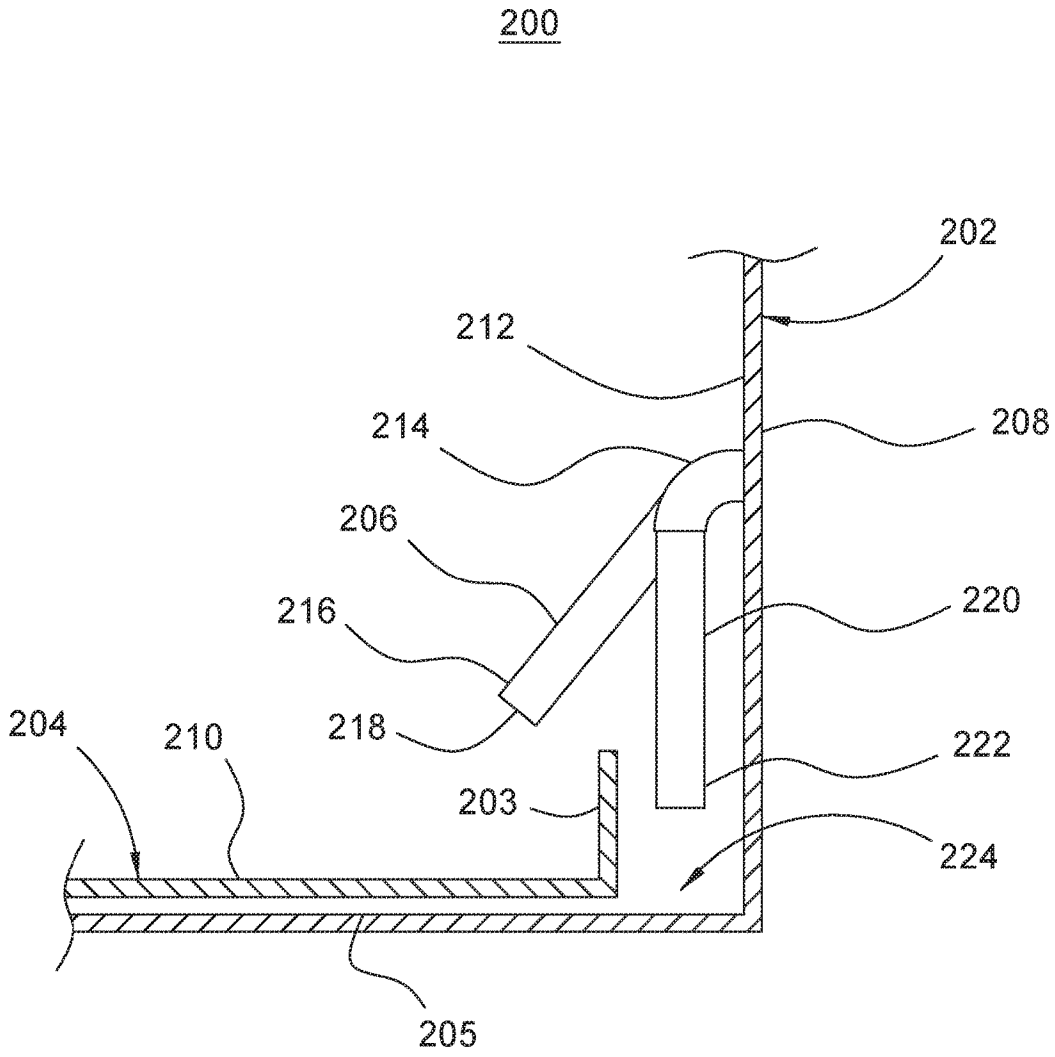
FIG. 2 a side cutaway view of a portion of an assembled PTAC system including guide structure to allow placement of treatment pellets into the PTAC, in accordance with some embodiments.

FIG. 2 a side cutaway view of a portion of an assembled PTAC system 200 including one or more guide structures to allow placement of treatment pellets into the PTAC, in accordance with some embodiments. A wall sleeve 202 includes a sidewall 208 having an inside or interior surface 212 that is opposite the exterior surface on the outside of the wall sleeve 202 (which faces the wall in which it is installed). Mounted inside the wall sleeve is a chassis, of which, shown here, is a chassis drain pan 204, having a bottom 210, in which water condensate is collected from an evaporator coil (not shown). The chassis drain pan 204 is mounted on structure of the wall sleeve 202 that elevates the bottom of the chassis drain pan above the bottom 205 of the wall sleeve 202. Specifically, the chassis is designed to be slid into the wall sleeve 202, where, once the chassis is in the proper position in the wall sleeve 202, a portion of the chassis can be screwed or bolted to corresponding portions of the wall sleeve 202. A side 203 of the chassis drain pan 204 provides a barrier to contain water collected in the chassis drain pan 204. The chassis drain pan 204 is mounted in the wall sleeve 202 such that a gap 224 is provided between the interior 212 of the sidewall 208 of the wall sleeve 202 and the side 203 of the chassis drain pan 204. In other words, there is a space between the chassis 203 and the side of the wall sleeve 202.

Attached to, or mounted on the inside 212 of the sidewall 208 of the wall sleeve 202 are several guide structures 206, 220. The guide structures 206, 220 are provided such that their upper portions 214 each correspond to a respective aperture or opening (e.g. 112, 114, 116) through the sidewall 208. A first guide structure 206 can be in the form of a tube that is bent at an angle at the top portion 214. A lower portion 216 extends outward and downward such that a lower opening 218 is positioned over the chassis drain pan 204. Thus, when a treatment pellet is inserted into the corresponding opening through the sidewall 202, the treatment pellet is guided by the first guide structure 206 such that gravity moves the treatment pellet downward through the guide structure 206 until the treatment pellet falls into the chassis drain pan 204. Thus, the PTAC unit does not need to be taken apart in order to place treatment pellets (or tablets, liquids, etc.) into the chassis drain pan 204.

A second guide structure 220, having its top portion mounted in correspondence with a second opening through the sidewall 208, is configured to guide a treatment pellet from the second opening, upon insertion of the treatment pellet through the second opening, into the wall sleeve drain pan, formed by the bottom 205 of the wall sleeve 202, through gap 224. The lower portion 222 of the second guide structure 220 is configured such that anything passing through the guide structure 220 will fall past the chassis drain pan 204 and to the bottom 205 of the wall sleeve 202. In some embodiments both the first and second guide structures 206, 220 can be made of sections of copper tubing such as that commonly used in plumbing applications. In some embodiments the guide structures 206, 220 can be made of plastic tubing or piping, such as polyvinyl chloride (PVC) piping.

Figure 3:
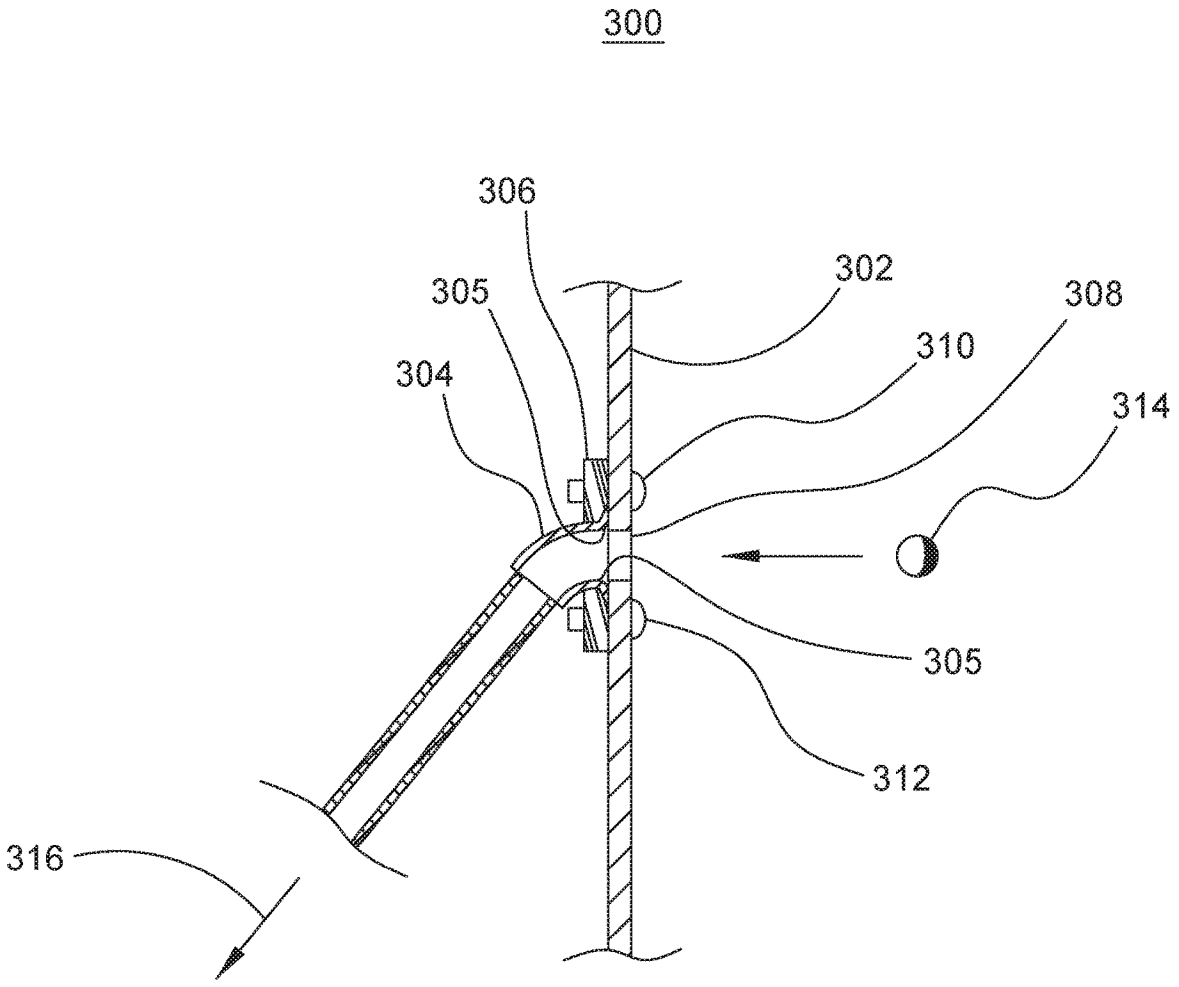
FIG. 3 is side cutaway view of a sidewall of a wall sleeve and a guide structure for guiding a treatment pellet into a chassis drain pan of the PTAC, in accordance with some embodiments.

FIG. 3 is side cutaway view 300 of a sidewall 302 of a wall sleeve and a guide structure 304 for guiding a treatment pellet 314 into a drain pan of the PTAC, in accordance with some embodiments. The guide structure 304 can be a tube component having a flared opening 305 against which a bracket 306 bears to hold the guide structure 304 in place. The flared opening 305 is positioned in correspondence with an opening or aperture 308 through the side wall 302. The bracket 306 can be held against the interior of the side wall 302 and the outside of the flared opening 305 of the guide structure 304 by rivets 310, 312 that pass through the side wall 302 and the bracket 306, thereby holding the guide structure 304 in place. Upon inserting a treatment pellet 314 into the opening 308, the treatment pellet 314 will begin rolling down the guide structure 304 in the direction of arrow 316 until it exits the guide structure 304, and into the chassis or wall sleeve drain pan. The treatment pellet can be spherically shaped and sized to fit through the opening 308 and the guide structure 304. Being spherical, the treatment pellet 314 will easily roll down the guide structure 304. As shown there, there is a short horizontal section of the guide structure 304 from the opening 308 to the downward directed portion, however, the guide structure 304 can also be configured to slope downwards from the opening 308, without any horizontal portion.

Figure 4:
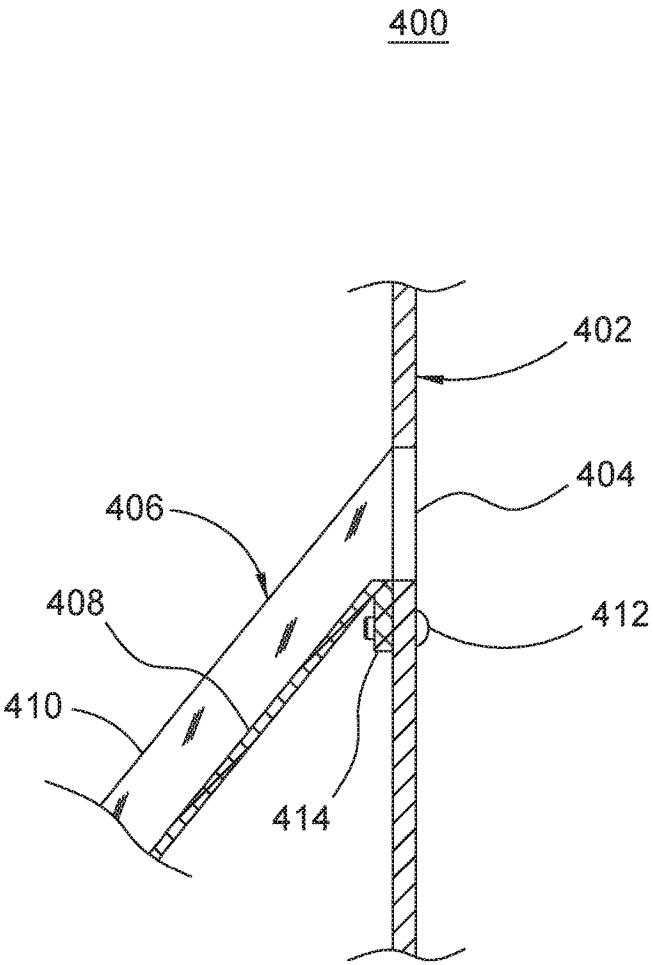
FIG. 4 is side cutaway view of a sidewall of a wall sleeve and a guide structure for guiding a treatment pellet into a portion of the PTAC, in accordance with some embodiments.

FIG. 4 is side cutaway view 400 of a sidewall 402 of a wall sleeve and a guide structure 406 for guiding a treatment pellet into a drain pan of the PTAC, in accordance with some embodiments. The guide structure 406 is positioned in correspondence with an aperture or opening 404 through the sidewall 402, and is configured as a chute having a bottom 408 and sides 410 which extend upward from the bottom 408. The guide structure 406 can be held in place by a rivets such as rivet 412 (two such rivets can be used) through a lower lip 414 which can be a portion of the bottom 408 that is bent at an angle to the bottom 408 such that the bottom 408 is at a desired downward angle. This configuration for a guide structure can be used for many shapes of treatment pellets, including disks or tablets, as well as liquids. The guide structure 406 can be made out of sheet metal that has portions bent to form the sides 410 and bottom 408.

Figure 5:
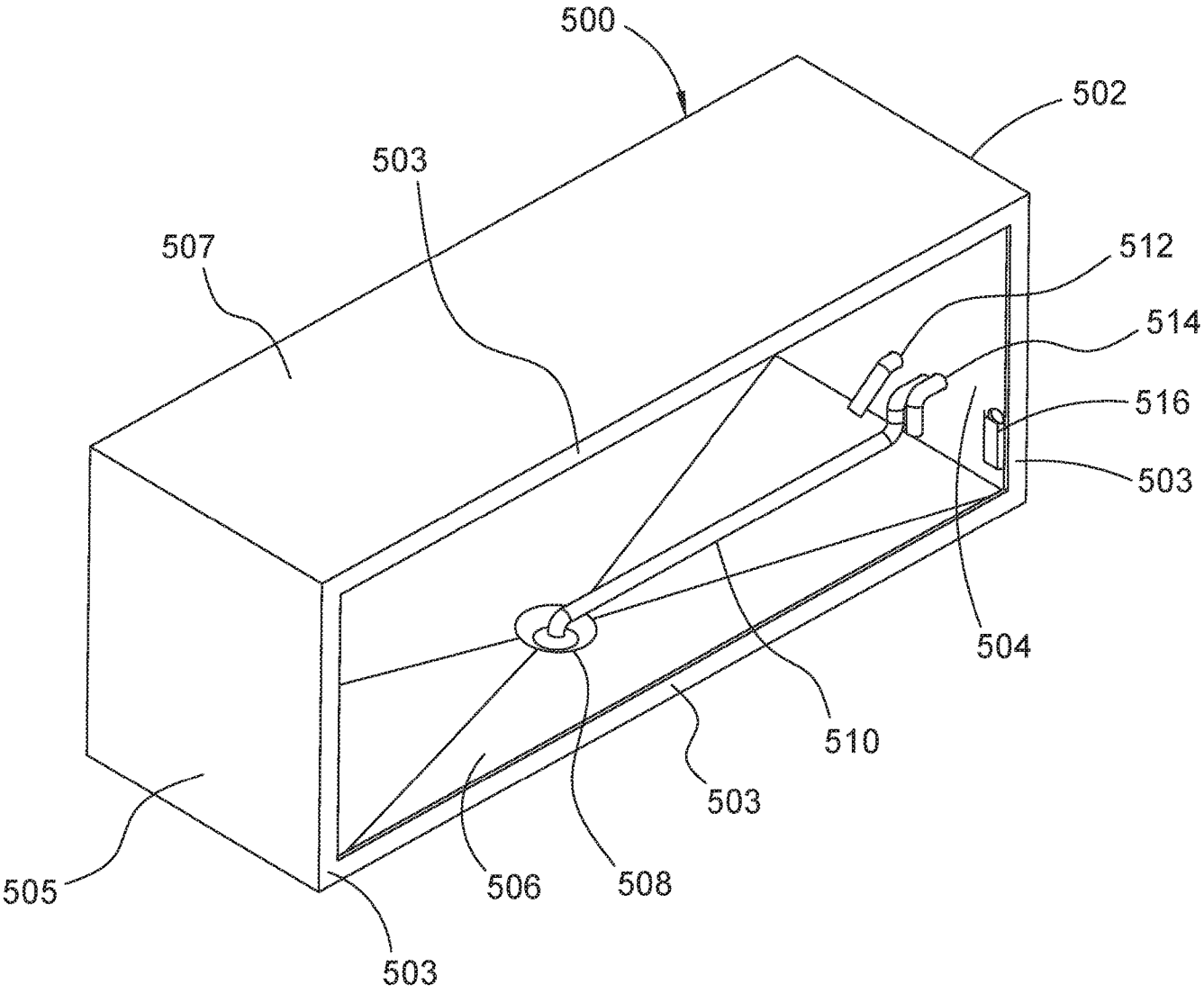
FIG. 5 is a perspective view of a wall sleeve include guide structure for treatment pellets and for a drain snake under a chassis installed that would be installed into the wall sleeve, in accordance with some embodiments.

FIG. 5 is a perspective view of a wall sleeve 500 including guide structures for treatment pellets and for a drain snake under a chassis installed that would be installed into the wall sleeve, in accordance with some embodiments. The wall sleeve 500 is shown outside of a wall, and is configured to be installed in a through-hole in a wall, as is well known. A chassis including the air conditioner components and circuitry is mounted in the wall sleeve 500 and typically secured to the wall sleeve 500 using screws or bolts at a front rim 503 of the wall sleeve 500 which is inside the room or structure in which the wall sleeve 500 is mounted. The front rim 503 surrounds the front opening through which the chassis is inserted to mount the chassis into the wall sleeve 500.

The wall sleeve 500 has first sidewall 502 that has an inside or interior surface 504. The wall sleeve 500 further includes a bottom 506, a second sidewall 505 and a top 507. The bottom 506 includes a drain opening 508, and the bottom 506 can be shaped to slope slightly downward from the sides to the drain opening 508 from the perimeter of bottom 506 to facilitate drainage. In some embodiments the edge of the drain hole 508 can be about one half inch to one and one half inches below the edges of the bottom 506, where the bottom 506 meets the sides. When the chassis is mounted into the wall sleeve 500, overflow from the chassis drain pan can drain into the bottom 506 of the wall sleeve 500 and through the drain hole 508 into a drain pipe. In some embodiments, however, water can be drained directly through the back/outside of the wall sleeve 500 to the outside environment.

The first sidewall 502 has several openings or apertures formed through the first sidewall from an exterior to the interior. There are several guide structures 510, 512, 514 which each have an end positioned in correspondence with a respective one of the several openings through the first sidewall 502. Guide structure 510 can be a tube that is configured to be against, or in sufficient proximity to the bottom 506 of the wall sleeve 500 to be under the chassis when the chassis is mounted in the wall sleeve, and traverses across the wall sleeve 500 from the interior 504 of the first sidewall 502 at an opening to the bottom 506, and across the bottom 506 to the drain hole 508. The end of the guide structure 510 at the drain hole 508 is turned downward to direct anything passing through guide structure 510 into the drain through drain hole 508. For example, a drain snake can be passed from the outside of the PTAC unit through the opening corresponding to the guide structure 510, and through the guide structure 510 into the drain pipe through the drain hole 508 in order to clean out the drain pipe and dislodge any material that may be blocking the drain. Further, drain maintenance liquids (e.g. "drain de-clogger") can be poured through guide structure 510 directly into the drainage line. These maintenance operations can be performed without having to disassemble the PTAC unit.

Likewise another guide structure 512 can be configured to have a free end disposed over the chassis drain pan when the chassis is mounted in the wall sleeve 500, and is mounted on the interior 504 of the first side wall 502 of the wall sleeve at an aperture through the sidewall 502. Thus, guide structure 512 allows a person to deposit a treatment pellet into the chassis drain pan by inserting the treatment pellet into the aperture through the sidewall 502 corresponding to the guide structure 512, whereupon gravity will draw the treatment pellet down and through the guide structure 512 where the treatment pellet will fall into the chassis drain pan. Another guide structure 514 is configured to direct treatment pellets from yet another aperture through the sidewall 502 into the wall sleeve bottom 506, which acts as a wall sleeve drain pan. Guide structure 514 is similar to guide structure 220 of FIG. 2, and directs treatment pellets though a gap between the chassis drain pan and the interior 504 of the first sidewall 502, or through a tube or passageway formed in the chassis drain pan. An alternative guide structure 516 can be formed over the interior 504 of the first sidewall 502 that creates a passage between the interior surface 504 and the guide structure 516 to guide treatment pellets into the bottom 506 of the wall sleeve 500. In particular disk-shaped tablets can be inserted into the opening corresponding toe guide structure 516 and even stacked inside guide structure 516, allowing the bottom tablet to dissolve slowly, so that if maintenance personnel see room to add another tablet they can, and won't need to do so before there is room to add another tablet.

Guide structures 510, 512, 514, 516 are mounted on the interior 504 of the first side wall in a position so that the chassis of the PTAC unit can be moved in and out of the wall sleeve 500 without the guide structures 510, 512, 514, 516 snagging or interfering with the movement of the chassis in or out of the wall sleeve 500. In particular, guide structure 512, which extends over the chassis drain pan when the chassis in mounted in the wall sleeve 500, does not extend far enough into the interior space of the wall sleeve that it will be in the way of components on the chassis when the chassis is moved into or out of the wall sleeve 500. Accordingly, components on the chassis have to be configured such that there is clearance for the guide structure 512, and that the chassis drain pan will be under the lower end of guide structure 512.

Figure 6:
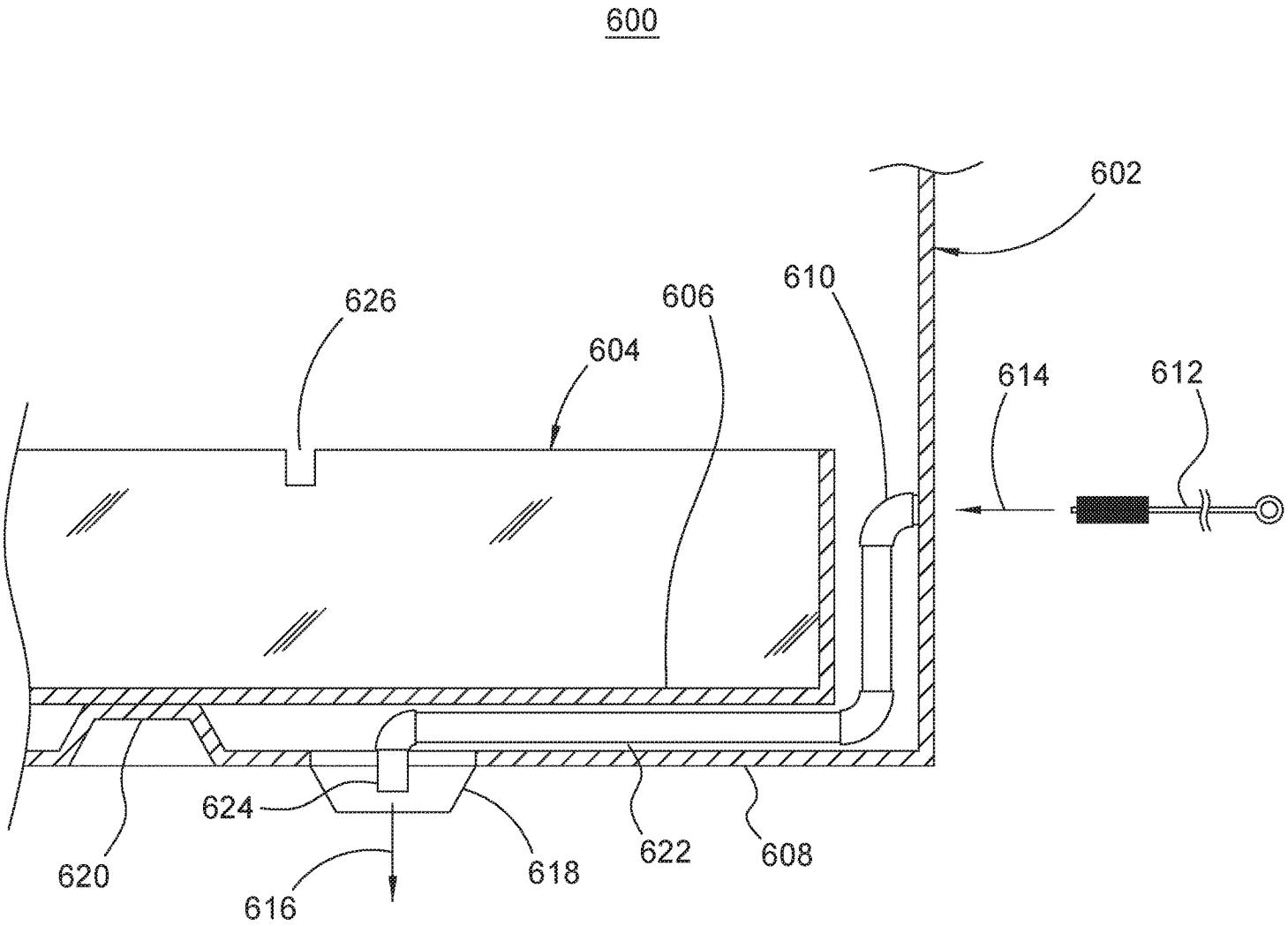
FIG. 6 is a side cutaway view of a PTAC showing a drain snake guide structure, in accordance with some embodiments.

FIG. 6 is a side cutaway view of a PTAC unit 600 showing a drain snake guide structure, in accordance with some embodiments. A wall sleeve 602 holds a chassis that includes a chassis drain pan 604 having a bottom 606. The chassis drain pan 604 holds a selected level of water that condenses on the evaporator coil and drains down into the chassis drain pan 604. The collected water is used to cool the condenser coil by the condenser fan splashing the collected water and blowing it into the condenser coil, as is well known. Excess water drains into the bottom 608 of the wall sleeve 602, under the chassis drain pan 604 through, for example, notch 626 in the side of the chassis drain pan 604. The chassis is mounted in the wall sleeve 602 such that there is a gap or space between the bottom 606 of the chassis drain pan 604 and the bottom 608 of the wall sleeve 602. For example, several upward bosses 620 can be formed into the bottom 608 of the wall sleeve 602 that bear against the bottom 608 of the chassis drain pan 604 or other parts of the chassis. The bottom 608 is shown flat here, but can be configured to slope from the sides to the drain hole 618 to facilitate drainage. A guide structure 622 is provided in this space, and has a first end 610 positioned in correspondence with an opening through the sidewall of the wall sleeve 602. The guide structure 622 can be a tube or narrow pipe assembly and has a second end 624 positioned over a drain hole 618. A drain snake 612 can be inserted into the guide structure 622 in the direction of arrow 614 through the opening, and along the guide structure 622 until it comes out the second end 624 in the direction of arrow 616 and into the drain line. Thus, the guide structure 622 allows maintenance of the drain line without having to remove the chassis from the wall sleeve 602.

Figure 7:
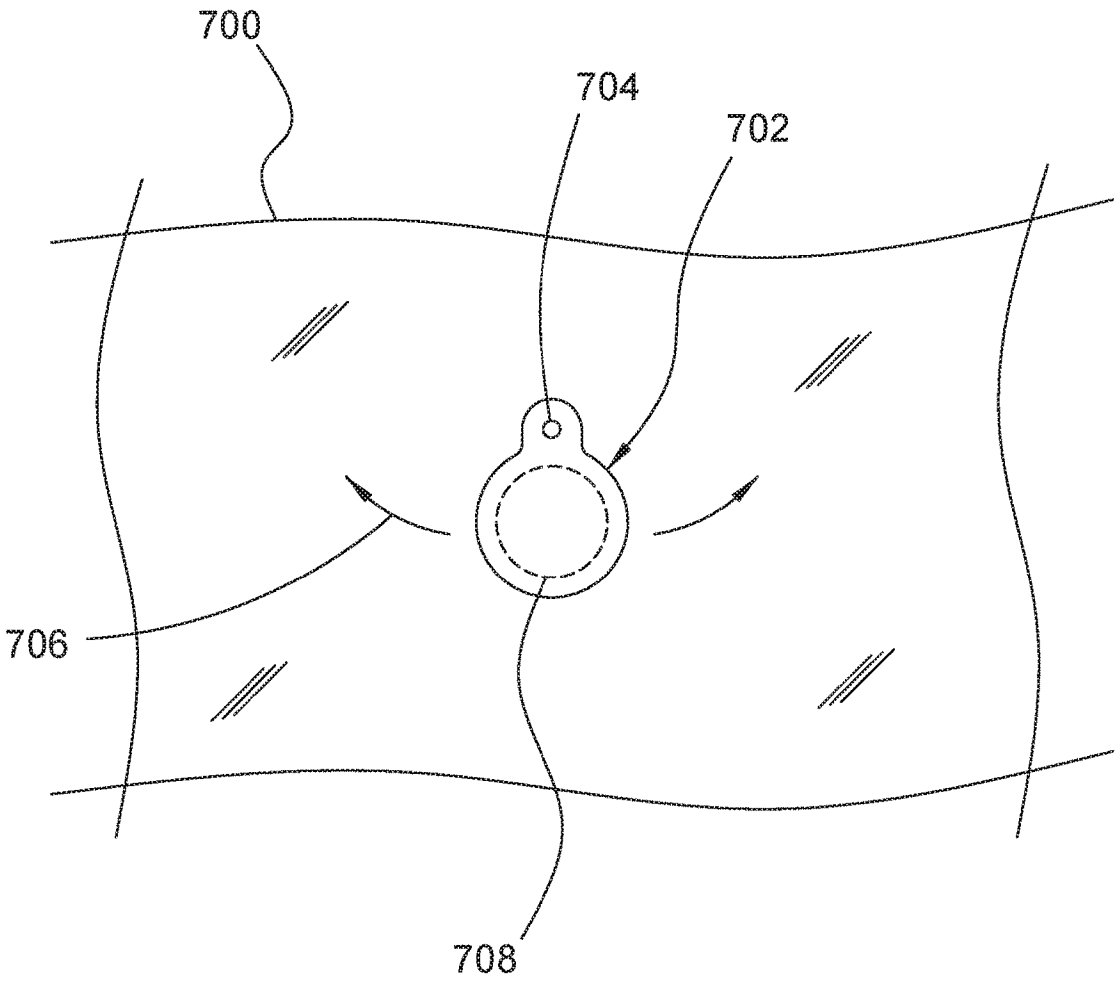
FIG. 7 shows a side elevational view of a sidewall of a wall sleeve, at the outside, on which a cover is mounted for covering an aperture formed through the sidewall, in accordance with some embodiments.

FIG. 7 shows a side elevational view of a sidewall 700 of a wall sleeve, at the outside, on which a cover 702 is mounted for covering an aperture 708 formed through the sidewall, in accordance with some embodiments. In this view the cover 702 is positioned over (covering) the aperture 708. The aperture 708 is an opening through the sidewall 700 and a guide structure is positioned on the other side of the sidewall 700 in correspondence with the aperture 708. The aperture 708 is sized such that a treatment pellet or tablet can pass through the aperture. In some embodiments the aperture 708 can be sized to exclude standard tablet/disc shaped treatment pellets commonly available on the market but sized large enough to accept a spherical treatment pellet that will roll down the corresponding guide structure.

The cover 702 can be a flat member that is attached to the sidewall 700 at a pivot point 704 that allows the cover 702 to move about the pivot point 704 as indicated by arrows 706. The pivot point is located directly over the aperture 708 and the cover 702 hangs on the pivot point 704 such that it naturally covers the aperture 708 unless moved to the side (i.e. in the direction of arrow 706). The cover 702 prevents debris and other objects from entering the PTAC unit. When a treatment pellet is to be provided into the PTAC unit, the cover 702 can be moved by pivoting it around the pivot point 704 to reveal the aperture 708, thereby allowing a treatment pellet to be inserted into the opening 708. The pivot point 704 can be a rivet or similar feature that attaches to the sidewall 700. Other forms of covers can be used equivalently, including, for example, a flap that hangs over the aperture 708 or several apertures, having a bottom that lifts up and away from the sidewall.

Figure 8:
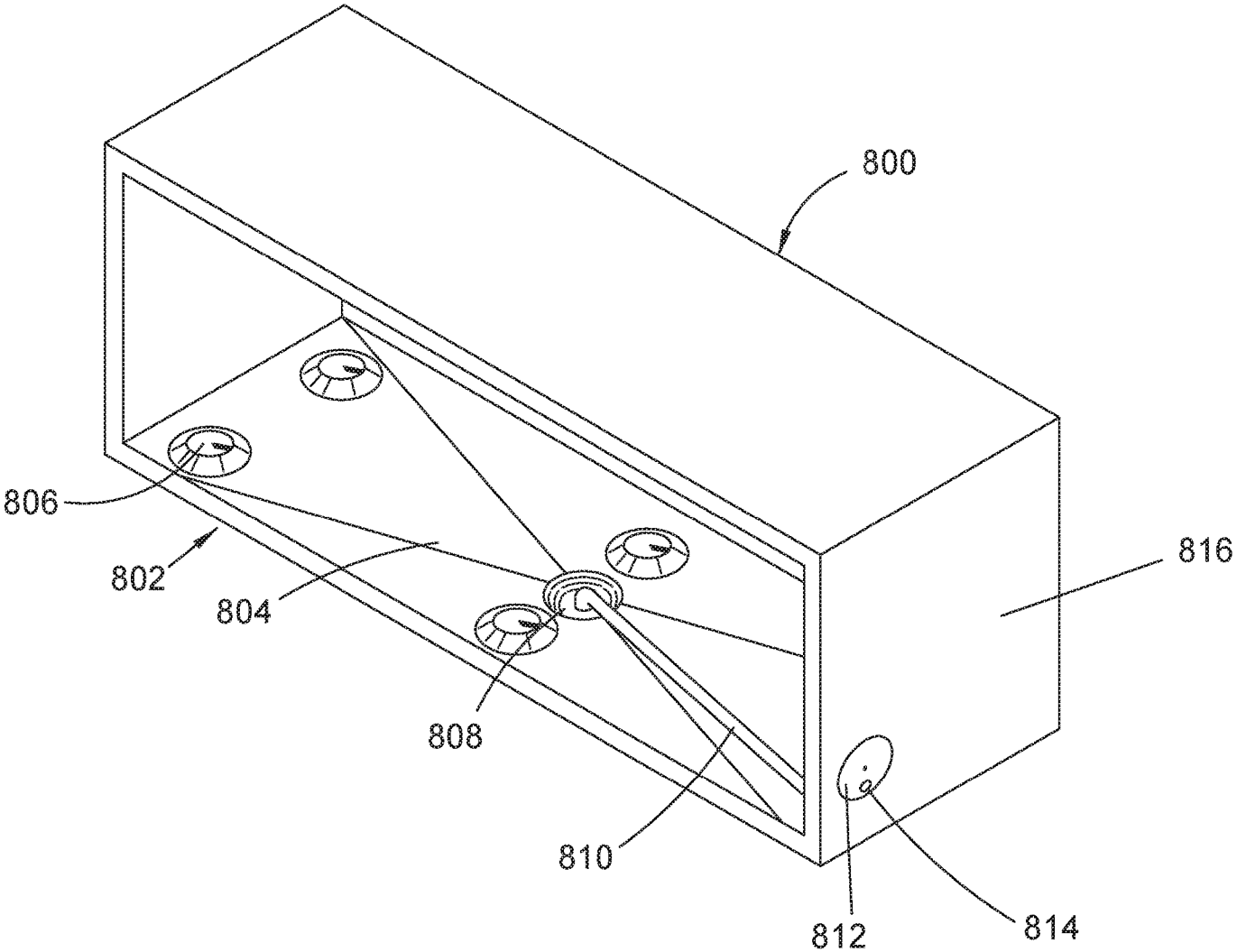
FIG. 8 shows a perspective view of a wall sleeve assembly showing an outside of the side of the wall sleeve where a rotating cover is mounted, in accordance with some embodiments.

FIG. 8 shows a perspective view of a wall sleeve 800 for a PTAC unit that is designed in accordance with some embodiments. In particular, the wall sleeve 800 provides drainage and maintenance features not found on existing PTAC units. The front 802 of the wall sleeve 800 is open, which allows for a PTAC chassis to be inserted into the wall sleeve 800. The wall sleeve 800 is itself mounted through a wall so that heat can be removed from an interior space to the exterior space by otherwise conventional air conditioning techniques. The wall sleeve 800 has a bottom 804 that is sloped toward a drain 808. That is, where the bottom 804 meets the drain is the lowest point of the bottom 804, with the highest part of the bottom 804 being where the bottom 804 meet the sides, such as side 816. The drain hole 808 can be on the order of one half inch to one and one half inches lower than the edges of the bottom 804 where the bottom 804 meets the vertical sides of the wall sleeve 800. The bottom 804 can include several standoffs 806 which are raised portions that support the chassis and create space between the bottom of the chassis and the rest of the bottom 804. A drain access tube 810 is a guide structure that can be used to guide a drain cleaning tool into the drain 808. The drain access tube 810 therefore has one end over the drain 808 and another end on the side 816, which can be concealed by a rotating cover 812. The rotating cover 812 is a circular member that is mounted on the side 816 so as to rotate about its center point. The rotating cover 812 has an opening 814 formed through the rotating cover 812, and by rotating the rotating cover about its center mounting point allows a user to align the opening 814 with the opening of any of two or more different guide structures, the drain access tube 810 being one of the guide structures. The opening 814 has a center that is a distance away from the center of the rotating cover 812, and as a result, when the rotating cover 812 is rotated, the opening follows a circular path. The openings of the various guide structures are positioned in correspondence with this circular path. In the present example there are three total guide structures. The other two guide structures allow a user to deposit treatment pellets into the chassis pan or to the bottom 804 of the wall sleeve 800 which acts as a wall sleeve drain pan.

Figure 9:
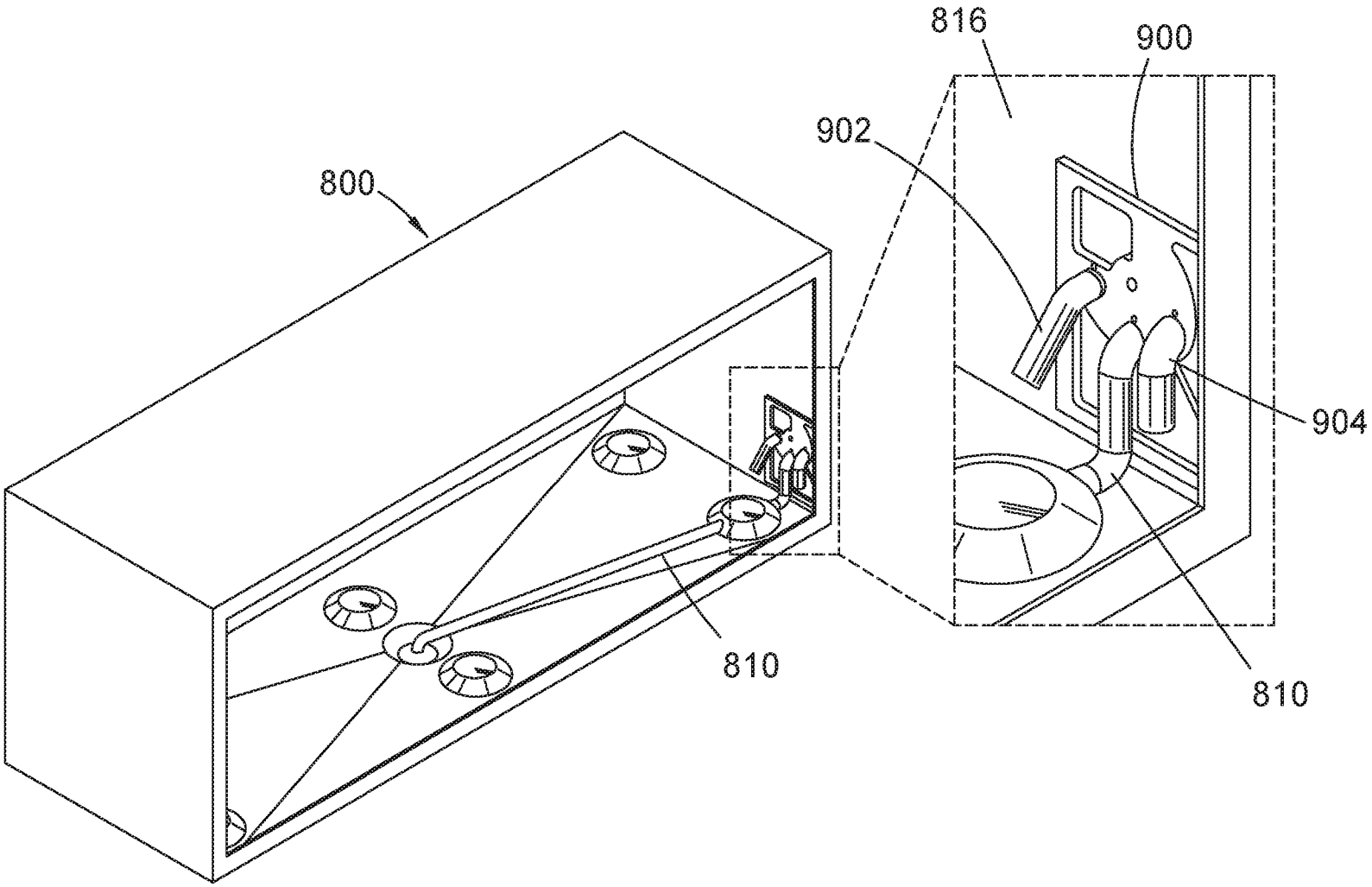
FIG. 9 shows a perspective view of a wall sleeve assembly showing an inside of the side of the wall sleeve where a mounting plate is mounted, and including a detail showing the various guide structures mounted in the wall sleeve, in accordance with some embodiments.

FIG. 9 shows a perspective view of the wall sleeve 802, showing the inside of side 816, and the guide structures attached to the side of the wall sleeve, in accordance with some embodiments. A mounting plate 900 is used to capture the openings of guide structures 902, 904, and drain access tube 810 in alignment with corresponding holes through the side 816 of the wall sleeve. Guide structure 902 can be configured to guide a treatment pellet into the chassis pan from an opening on the side 816. Likewise, guide structure 904 can be configured to guide a treatment pellet into the bottom 804 of the wall sleeve 800. The openings of guide structures 810, 902, 904 are arranged on circular path that is traversed by the opening 814 of the rotating cover 812 on the outside of side 816.

Figure 10:
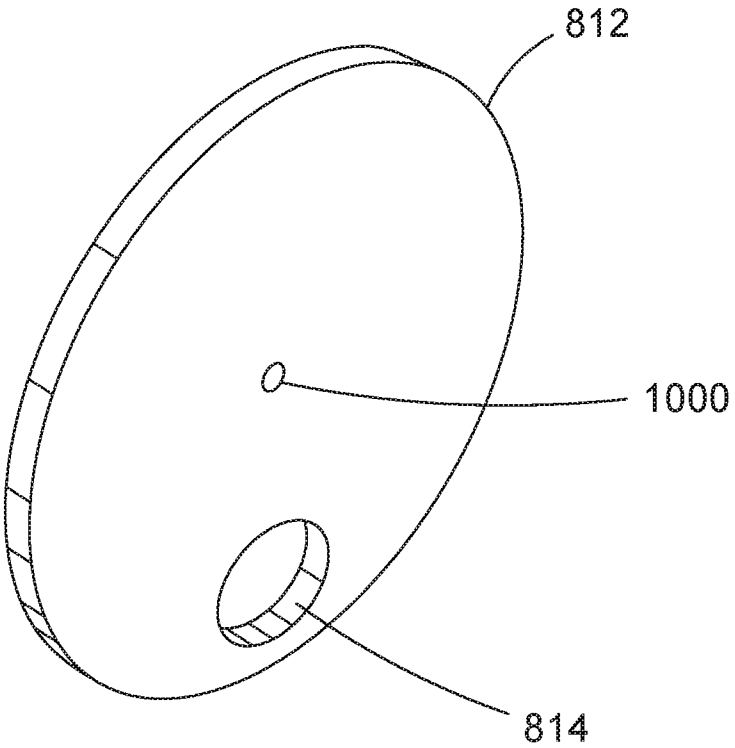
FIG. 10 shows a perspective view of a rotating cover, in accordance with some embodiments.
Figure 11:
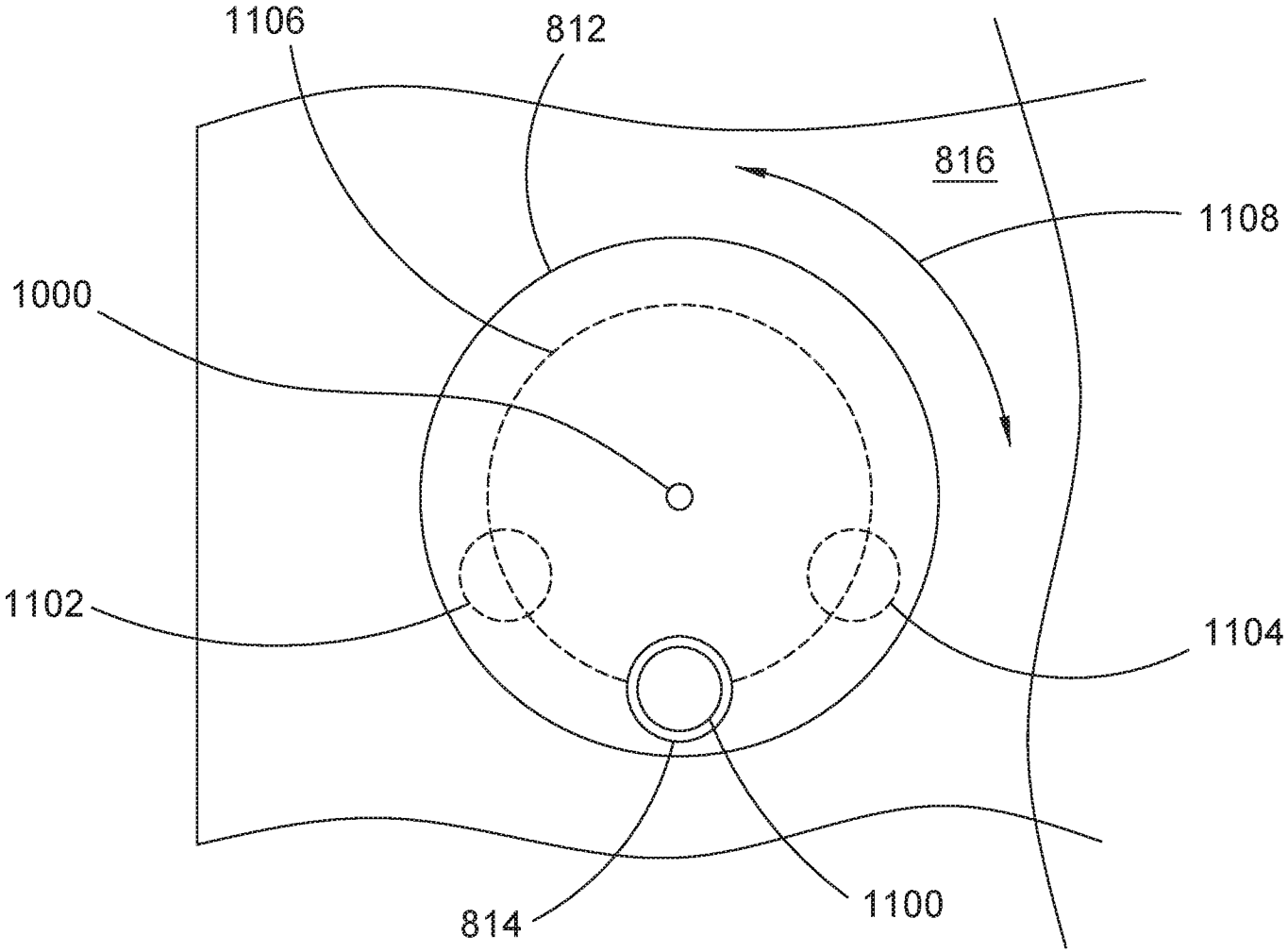
FIG. 11 shows an elevational view of a rotating cover as mounted on the side of a wall sleeve, in accordance with some embodiments.

FIG. 10 shows a rotating cover 812 for use on the outside side of a wall sleeve 800, in accordance with some embodiments. The rotating cover 812 can be a circular disk having a mounting hole 1000 at the center of the disk about which the rotating cover 812 will rotate once mounted on the wall sleeve 800. The rotating cover 812 has an opening 814 through the rotating cover 812 that allows access to the opening of any of the various guide structures by rotating the rotating cover 812 until the opening 814 aligns with the opening of the desired guide structure. As the rotating cover 812 rotates about the mounting hole 1000, the opening 814 follows a circular path. FIG. 11 shows the rotating cover 812 mounted on the side 816 of the PTAC wall sleeve. The rotating cover 812 is mounted on a fastener that passes through the mounting hole 1000 and the side 816 of the wall sleeve. Accordingly, the rotating cover 812 can rotate about the mounting hole 1000 as indicated by arc 1108. Further, opening 814 follows a circular path 1106 as the rotting cover 812 is rotated. The rotation is in a plane that is parallel to the plane of the side 816 of the wall sleeve. Also located in the circular path 1106 are the openings of several guide structures 1100, 1102, 1104. Each of the openings 1100, 1102, 1104 connects to a different, respective guide structure. For example, opening 1100 can connect to the drain access tube 810, opening 1102 can connect to guide structure 904, and opening 1104 can connect to guide structure 902. The openings 1100, 1102, 1104 can be the open end of the guide structures, which necessarily have to pass through similar openings in the side 816 of the wall sleeve. Alternatively, the openings 1100, 1102, 1104 can be openings in the side 816 which lead to the open end of the guide structures.

Figure 12:
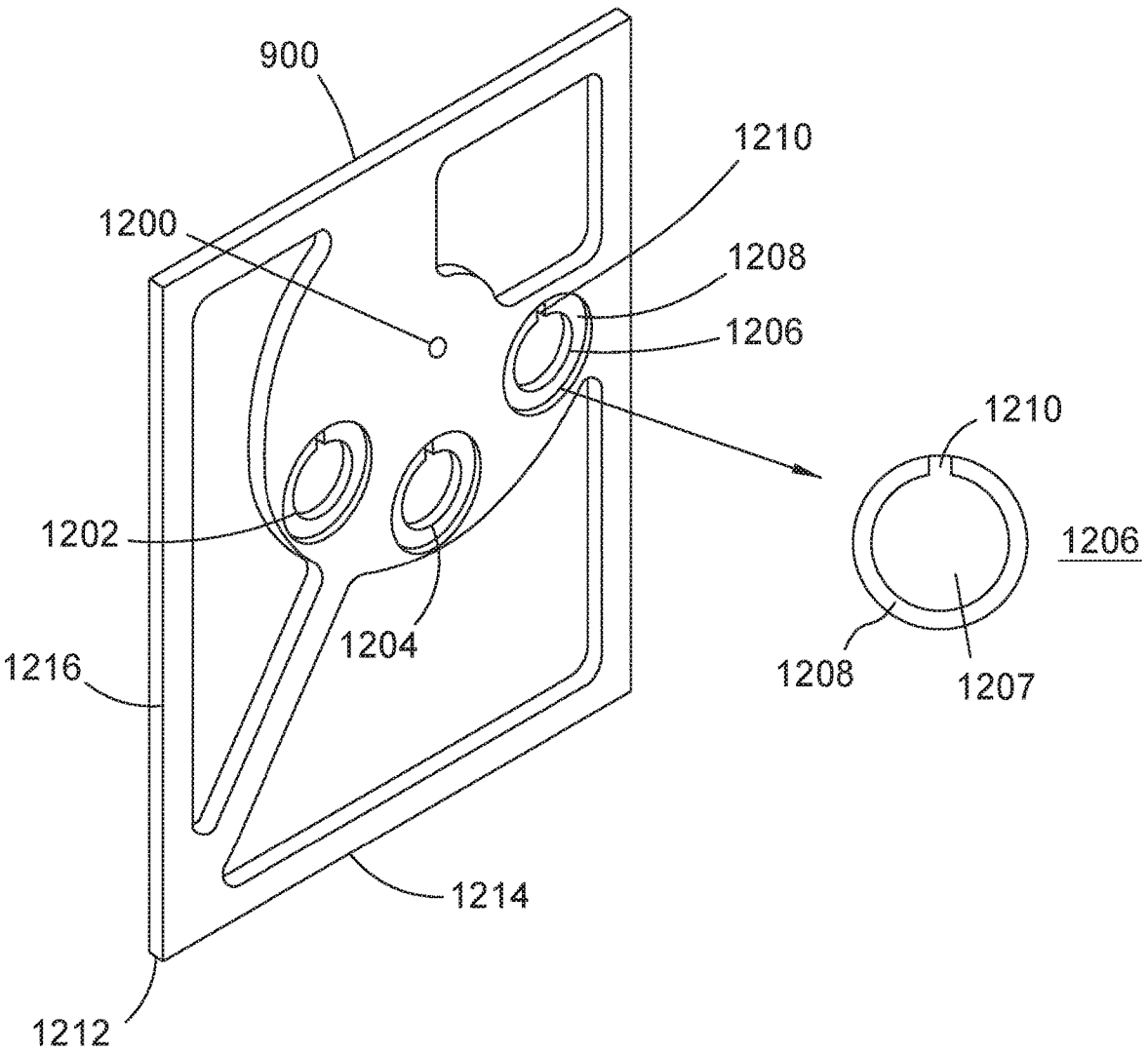
FIG. 12 shows a perspective view of a mounting plate for use in mounting guide structures in a wall sleeve for a PTAC, in accordance with some embodiments.

FIG. 12 shows a mounting plate 900 for use in securing guide structures to the side a wall sleeve, in accordance with some embodiments. The mounting plate 900 aligns and captures the guide structures against the inside of the wall sleeve in correspondence with their respective openings through the side of the wall sleeve (e.g. 1100, 1102, 1104). The mounting plate 900 includes a through hole 1200. A pin or similar retaining structure (not shown) can pass through the through hole 1200 and the mounting hole 1000 of the rotating cover 812 and a corresponding hole in the side of the wall sleeve. The mounting plate 900 also include several shouldered holes 1202, 1204, 1206, which are arranged on a circle centered at the through hole 1200, which corresponds to circular path 1106 on which the openings 1100, 1102, 1104 are arranged. Further, each of the shouldered holes 1202, 1204, 1206 has an opening through the mounting plate 900 that is surrounded by a shoulder, in which an alignment notch is cut that is contiguous with the opening. This is shown in the detail of shouldered hole 1206 in which the opening 1207 is shown, surrounded by a shoulder 1208, in which an alignment notch 1210 is cut. The shoulder 1208 is a circular section of the mounting plate that is reduced in thickness to capture a portion of the guide structure between the shoulder 1208 and the inside of the wall sleeve. The mounting plate 900 can also include alignment features to align the mounting plate 900 to the inside of the wall sleeve. For example, the mounting plate 900 can include a corner 1212 formed by sides 1214, 1216. The corner 1212 and sides 1214, 1216 can align to a corresponding corner and sides on the inside of the wall sleeve, eliminating the need to measure the wall sleeve when installing the mounting plate 900 and guide structures.

Figure 14:
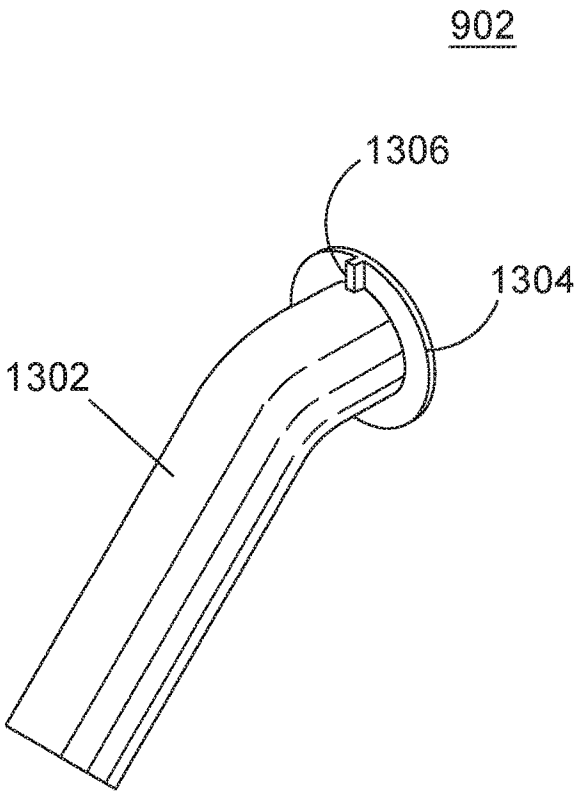
FIG. 14 shows a rear perspective view of a guide structure, in accordance with some embodiments.
Figure 13:
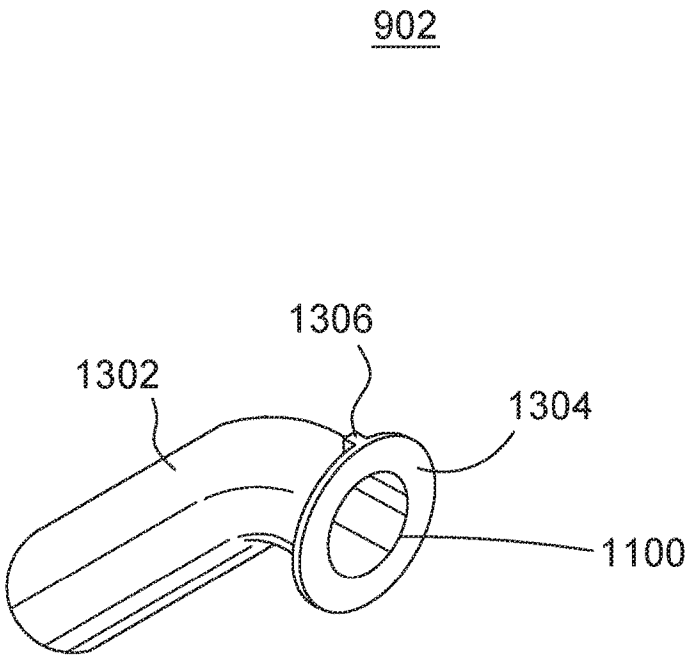
FIG. 13 shows a front perspective view of a guide structure, in accordance with some embodiments.
Figure 15:
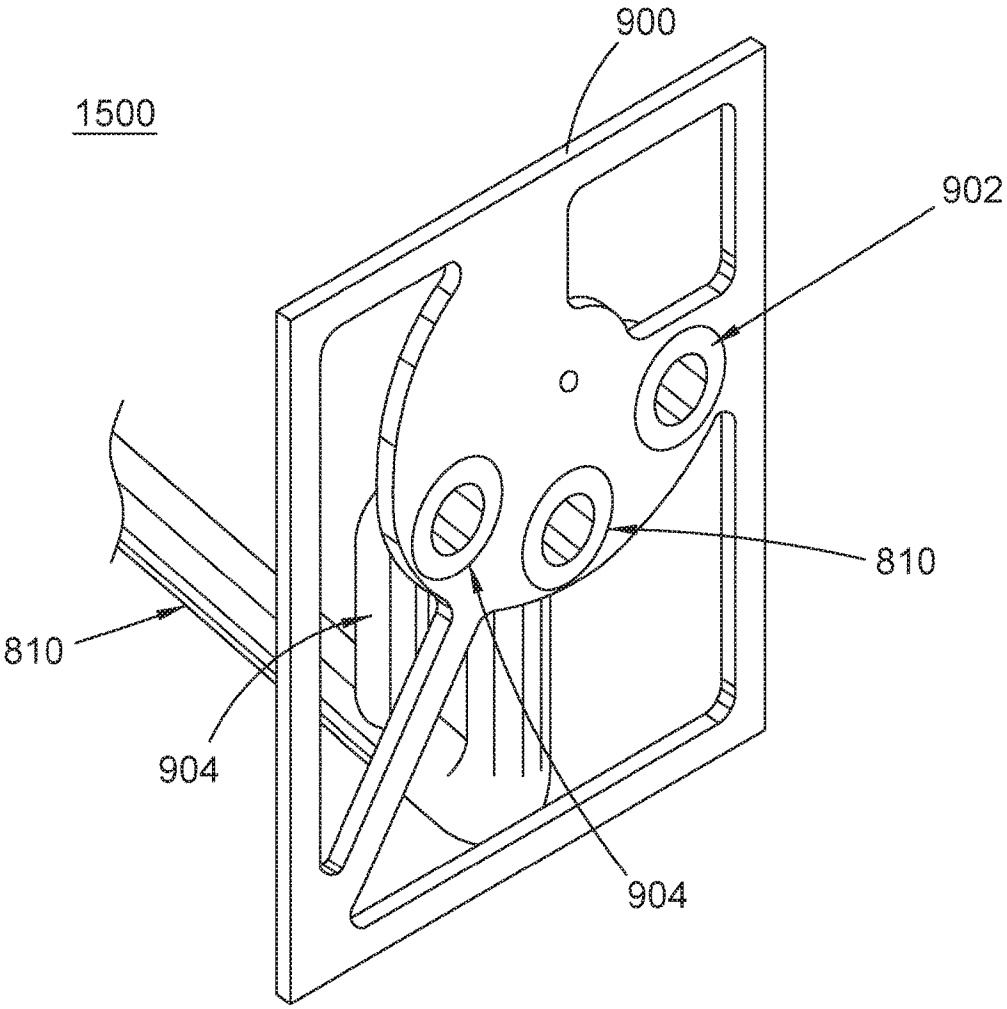
FIG. 15 shows a perspective view of a mounting plate with guide structures assembled into the mounting plate prior to mounting the mounting plate on a side, in accordance with some embodiments.

FIGS. 13 and 14 show front and rear perspective views, respectively, of a portion of a guide structure 902 to be mounted in a mounting plate such as mounting plate 900. The guide structure 902 is configured to guide a treatment pellet into a portion of a PTAC unit, or allow access to the drain for cleaning. The guide structure 902 can include a generally tubular body 1302 or equivalent structure formed to guide a treatment pellet or cleaning brush to a desired location in the PTAC from outside of the PTAC. The guide structure 902 has an end that forms an opening 1100 surrounded by a flange 1304. The flange 1304 is sized to correspond with the recess of the shoulder 1208 of the shouldered holes 1202, 1204, 1206 of the mounting plate 900. That is, the flange 1304 has a thickness that is as thick as the depth of the shoulder recess of the shoulder 1208. Further, the flange 1304 is generally flat across the face of the flange as it is captured between the shoulder 1208 and the inside surface of the side of the wall sleeve. An alignment tab 1306 can be provided to fit into the alignment notch 1210 to align the guide structure in a proper orientation. FIG. 15 shows an assembly 1500 of a mounting plate 900 with several guide structures 810, 902, 904 placed into the mounting plate 900 and ready to be mounted on the side of the wall sleeve. Each guide structure 810, 902, 904 has a flange portion that fits within a shoulder recess of a corresponding opening through the mounting plate 900. When the mounting plate 900 is mounted in place against the side (the inside) of the wall sleeve, the guide structures 810, 902, 904 will be captured in place. The rotating cover (e.g. 812) will be mounted on the outside of the side of the wall sleeve and will allow only one of the guide structures 810, 902, 904 to be accessible at a time, or to cover all of them so as to keep out debris or other matter.

A wall sleeve for a PTAC unit and a PTAC unit using the wall sleeve has been described that provides an external access port coupled with internally mounted guide structures that allow the provision of treatment pellets into the internal drain pan(s) of the PTAC unit without having to disassemble the PTAC unit. The embodiments of the inventive disclosure greatly simplifies routine maintenance to prevent growth and build-up of microbial matter than can foul internal components of the PTAC unit, which can reduce efficiency, and which can further block or obstruct drainage, resulting in leakage outside of the air conditioner unit that can damage interior structure, facilitate mold growth, and other issues associated with water leakage. By providing a simple and easy way to place treatment pellets into the PTAC unit, the PTAC unit does not have to be partially disassembled to place treatment pellets into the PTAC unit drain structures. This helps ensure that regular maintenance of PTAC units will be followed, and it greatly reduces the time needed to perform such maintenance.

What is claimed is:

1. A wall sleeve for a packaged terminal air conditioner (PTAC) that is configured to receive a chassis in which a compressor unit and an evaporator unit are provided, the chassis including a chassis drain pan, the wall sleeve comprising:

a front having an opening through which the chassis can be placed to mount the chassis in the wall sleeve;

a side wall having an exterior side and an interior side, a first aperture formed through the side wall; and a first guide structure disposed on an inside of the side wall at the interior side and having a receiving portion positioned in correspondence with the first aperture and a lower portion arranged in a position over the chassis drain pan when the chassis is mounted in the wall sleeve.

2. The wall sleeve of claim 1, wherein the first guide structure is a tube having a lower portion positioned at an angle with respect to the side wall of between zero and forty-five degrees.

3. The wall sleeve of claim 1, wherein the first guide structure comprises a ramp that is configured to direct a treatment tablet placed through the first aperture into the chassis drain pan.

4. The wall sleeve of claim 1, further comprising a cover disposed on the exterior side of the side wall of the wall sleeve, over the first aperture, wherein the cover is configured to be moveable to allow a user to place a treatment pellet into the first guide structure through the first aperture.

5. The wall sleeve of claim 1, wherein the wall sleeve includes a wall sleeve drain pan at a bottom of the wall sleeve, the wall sleeve further comprises:

a second aperture formed in the side wall of the wall sleeve; and a second guide structure having a receiving portion positioned in correspondence with the first aperture and a lower portion arranged in a position over the wall sleeve drain pan when the chassis is mounted in the wall sleeve.

6. The wall sleeve of claim 5, further comprising:

a third aperture formed in the side wall of the wall sleeve; and a guide tube having:

a first end disposed in correspondence with the third aperture;

a first downward portion configured to pass between the interior side of the side wall and the chassis drain pan when the chassis is mounted in the wall sleeve;

a horizontal portion extending from a bottom of the first downward portion to a second downward portion configured over a drain hole in the wall sleeve drain pan, and wherein the horizontal portion is disposed along the wall sleeve drain pan to be between the chassis drain pan and the wall sleeve drain pan when the chassis is mounted in the wall sleeve; and the second downward portion continues from the horizontal portion and turn downward into the drain hole of the wall sleeve drain pan.

7. A packaged terminal air conditioner (PTAC), comprising: a wall sleeve at least one opening formed through the wall sleeve at a side of the wall sleeve, the walk sleeve defining an internal space, and having an open front; a chassis having a chassis drain pan, the chassis disposed in the internal space of the wall sleeve, the chassis drain pan configured to collect condensate from an evaporator coil that is mounted in the chassis; and a first guide structure disposed in the internal space and connected, at an upper end of the guide structure, to in internal surface of a sidewall of the wall sleeve in correspondence with an opening through the sidewall of the wall sleeve, and having a lower end positioned over the chassis drain pan.

8. The PTAC of claim 7, further comprising a second guide structure having an upper end mounted to the sidewall of the wall sleeve in correspondence with a second opening through the sidewall of the wall sleeve, and having a lower end positioned over a wall sleeve drain pan formed in a bottom of the wall sleeve.

9. The PTAC of claim 8, further comprising a third guide structure having an upper end mounted at the inside of the wall sleeve in correspondence with a third opening, the third guide structure having a body portion that runs under the chassis drain pan to a drain hole in the bottom of the wall sleeve.

10. The PTAC of claim 7, wherein the lower end of the guide structure is configured at an angle of between zero of forty five degrees.

11. The PTAC of claim 7, wherein the guide structure comprises a tube.

12. The PTAC of claim 7, wherein the guide structure comprises a ramp having a bottom, and walls on opposing sides of the bottom.

13. The PTAC of claim 7, further comprising a cover disposed on an outside surface of the wall sleeve, over the opening, wherein the cover is configured to be moveable to allow a user to place a treatment pellet into the guide structure through the opening.

14. A wall sleeve for a packaged terminal air conditioner (PTAC) system, comprising, a sidewall having a first opening and a second opening formed through the sidewall, wherein each of the first and second openings are formed at a location that is selected to be exposed when the wall sleeve is mounted in a wall;

a bottom, wherein the bottom forms a wall sleeve drain pan and comprises a drain hole;

a front opening configured to receive a chassis therethrough, the chassis having a chassis drain pan;

a first guide structure having an upper portion mounted in correspondence with the first opening in the sidewall of the wall sleeve at an inside of the sidewall, the first guide structure having a lower end that is configured to be over the chassis drain pan when the chassis is mounted in the wall sleeve such that a treatment pellet placed through the first opening will be guided by the first guide structure from the first opening into the chassis drain pan; and a second guide structure having an upper portion mounted in correspondence with the second opening in the sidewall of the wall sleeve at the inside of the sidewall, the second guide structure having a lower end that is configured to be over the wall sleeve drain pan when the chassis is mounted in the wall sleeve such that a treatment pellet placed through the second opening will be guided by the second guide structure from the second opening into the wall sleeve drain pan.

15. The wall sleeve claim 14, wherein the sidewall includes a third opening in the sidewall, the wall sleeve further comprises a third guide structure having an upper portion at a first end that is mounted in correspondence with the third opening in the sidewall of the wall sleeve at the inside of the sidewall, the third guide structure having a lower end that is configured to sit between the chassis drain pan and the wall sleeve drain pan, and which has a second end positioned over the drain hole and which is turned downward toward the drain hole.

16. The wall sleeve of claim 14, wherein the bottom of the wall sleeve is sloped around the drain hole to direct water into the drain hole.

17. The wall sleeve of claim 14, wherein the first and second guide structures are made of tubing.

18. The wall sleeve of claim 14, further comprising a cover disposed on an outside of the sidewall over the first and second openings.

19. The wall sleeve of claim 14, wherein the lower end of the second guide structure is configured to pass, in part, between an exterior side of the chassis drain pan and an interior side of the sidewall.

20. The wall sleeve of claim 14, wherein the bottom of the wall sleeve comprises at least two raised features configured to support the chassis and maintain a separation between the chassis and the bottom of the wall sleeve outside of the at least two raised features.

* * * * *